US006972721B2

(12) United States Patent
Park

(10) Patent No.: US 6,972,721 B2
(45) Date of Patent: Dec. 6, 2005

(54) NOTEBOOK-COMPUTER

(75) Inventor: Myung-yong Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/727,635

(22) Filed: Dec. 5, 2003

(65) Prior Publication Data

US 2004/0239569 A1 Dec. 2, 2004

(30) Foreign Application Priority Data

Jun. 2, 2003 (KR) ..... 10-2003-0035333

(51) Int. Cl.[7] ..... H01Q 1/24
(52) U.S. Cl. ..... 343/702; 343/893
(58) Field of Search ..... 343/702, 720, 343/893

(56) References Cited

U.S. PATENT DOCUMENTS 6,344,825 B1 * 2/2002 Wong ..... 343/702
6,509,877 B2 * 1/2003 Masaki ..... 343/702
6,642,892 B2 * 11/2003 Masaki et al. ..... 343/702
6,670,926 B2 * 12/2003 Miyasaka ..... 343/702

* cited by examiner

*Primary Examiner*—Shih-Chao Chen
(74) *Attorney, Agent, or Firm*—Staas & Halsey LLP

(57) ABSTRACT

A notebook computer that can support various frequency bands with an internal-type antenna. The notebook computer includes a display device to display an image, a case installed on the outside of the display device and formed with an antenna groove on a front side thereof, an antenna provided in the antenna groove of the case, and a cover attached to the case and covering the front side of the case housing the antenna. The case and the cover can be attached by a simple combining structure, to prevent and/or minimize the space and/or the gap that may occur when they are attached.

20 Claims, 6 Drawing Sheets

NOTEBOOK-COMPUTER

CROSS-REFERENCE TO RELATED APPLICATIONS

This application claims the benefit of Korean Patent Application No. 2003-35333, filed Jun. 2, 2003, in the Korean Intellectual Property Office, the disclosure of which is incorporated herein by reference.

BACKGROUND OF THE INVENTION

1. Field of the Invention

The present invention relates to a notebook computer with an internal-type antenna that can support various frequency bands.

2. Description of the Related Art

Antennas installed in notebook computers play an important role. There are two types of antennas used with notebook computers, an internal-type and an external-type. The demand for, and use of, internal-type antennas is increasing due to factors such as portability and utility. Internal antennas are usually installed in the monitor to increase efficiency.

As shown in FIG. 1, a conventional notebook computer comprises a display device (not shown) that displays a picture, a case 4 installed on the outside of the display device and having antenna grooves 3 formed on both sides. Antennas 6 are inserted in the antenna grooves 3 of the case 4, and covers 8 are attached to each antenna groove 3, thereby covering the antennas 6.

In a conventional notebook computer, the case 4 is generally made of metal, which can negatively affect the reception of the antenna 6. Thus the cover 8 is made of plastic to prevent negative effects. However, careful quality control is required to prevent a space or a gap from forming due to screw coupling between the cover 8 and the case 4. This need for quality control increases cost while lowering productivity. Also, conventional notebook computers have a shortcoming in that the process of combining and separating the cover 8 becomes complicated due to the usage of additional coupling means, such as screws.

Additionally, the aesthetic value of a notebook computer may be depreciated due to unsightly combining structures of the cover 8 and the case 4.

SUMMARY OF THE INVENTION

Accordingly, it is an aspect of the present invention to provide a notebook computer, with an improved coupling structure for the case and the cover that has a pleasing external appearance, thereby solving the above and/or other problems.

Additional aspects and advantages of the invention will be set forth in part in the description which follows and, in part, will be obvious from the description, or may be learned by practice of the invention.

The foregoing and/or other aspects of the present invention are achieved by providing a notebook computer comprising: a display device displaying a picture; a case attached to the outside of the display device, having an antenna groove formed on the front side thereof; an antenna housed in the antenna groove of the case; and a cover attached to the case and covering the front side of the case and the antenna.

According to an aspect of the invention, the cover is formed with a plurality of combining hooks, and the case is formed with a plurality of hook holes corresponding to the combining hooks.

According to an aspect of the invention, the notebook computer further comprises an adhesive member to combine the cover and the case.

According to an aspect of the invention, the adhesive member is double-sided tape.

According to another aspect of the invention, a screw is set back from the edges of cover and the case, and combining hooks are at the opposite sides thereof. Furthermore, a plurality of screws can be utilized to connect the cover and the case. The plurality of screws can be located on the inside of the case, such that, when they are screwed through the case they screw into the cover away from the edges of the cover. In this manner, the screws provide a more secure connection between the cover and the case, they don't detract from the appearance of the cover because they are internal to the case, and they don't interfere with the operation of the combining hooks.

According to an aspect of the invention, the cover is made of plastic.

According to another aspect of the invention, the case is made of magnesium alloy.

In a notebook computer with antennas mounted on more than one edge of the case, additional covers can be provided to cover each edge that houses an antenna.

Additionally, the present invention as described above can also be used with flat panel monitors that are not connected to notebook computers.

BRIEF DESCRIPTION OF THE DRAWINGS

These and/or other aspects and advantages of the present invention will become apparent and more readily appreciated from the following description of the embodiments, taken in conjunction with the accompany drawings of which.

DETAILED DESCRIPTION OF THE PREFERRED EMBODIMENTS

Figure 1:
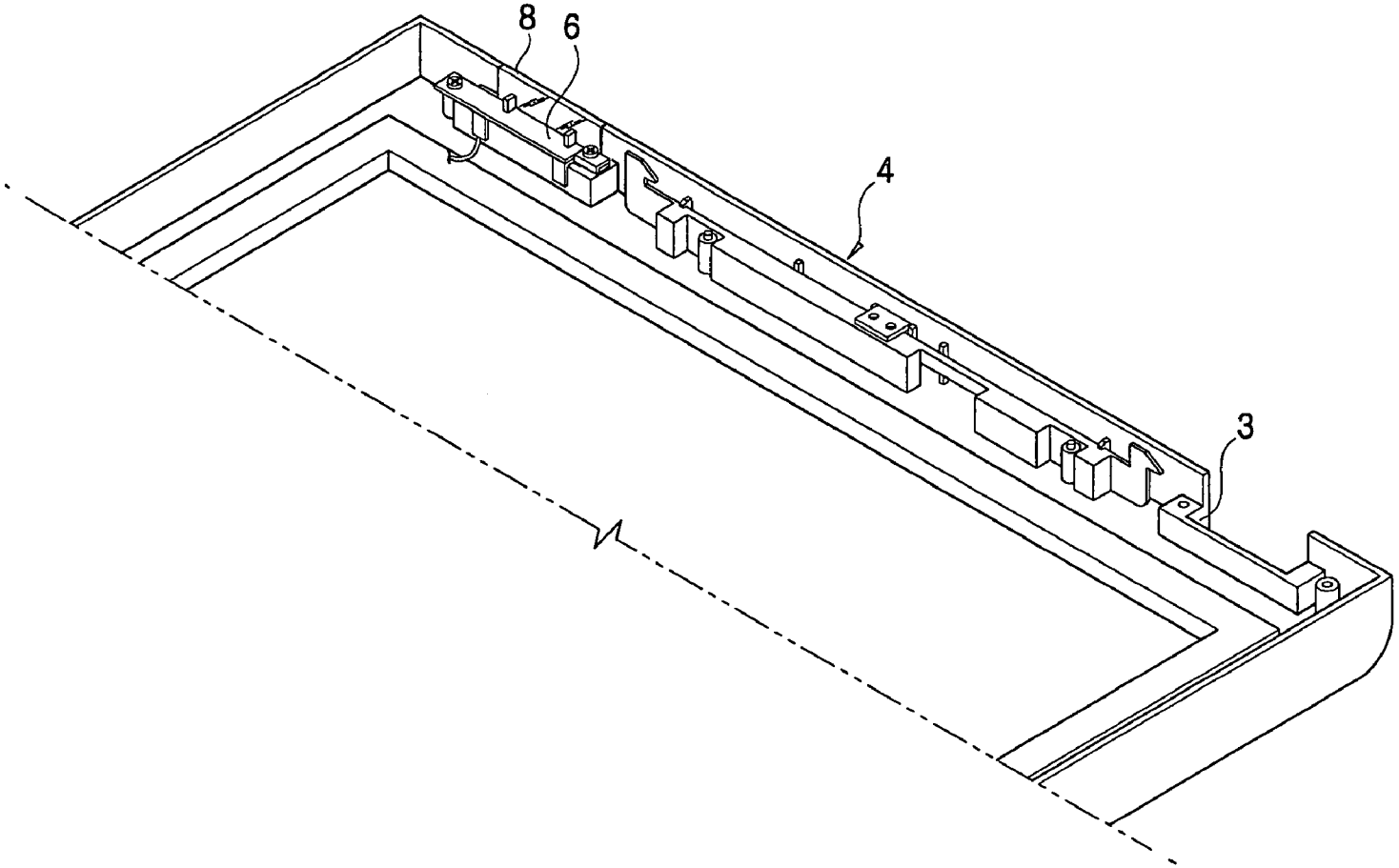
FIG. 1 (PRIOR ART)
FIG. 1 is a partial perspective view of a coupling structure of a conventional notebook computer.

Reference will now be made in detail to various aspects of the present invention, examples of which are illustrated in the accompanying drawings, wherein like reference numerals refer to like elements throughout. The embodiments are described below in order to explain the present invention by referring to the figures.

Figure 2:
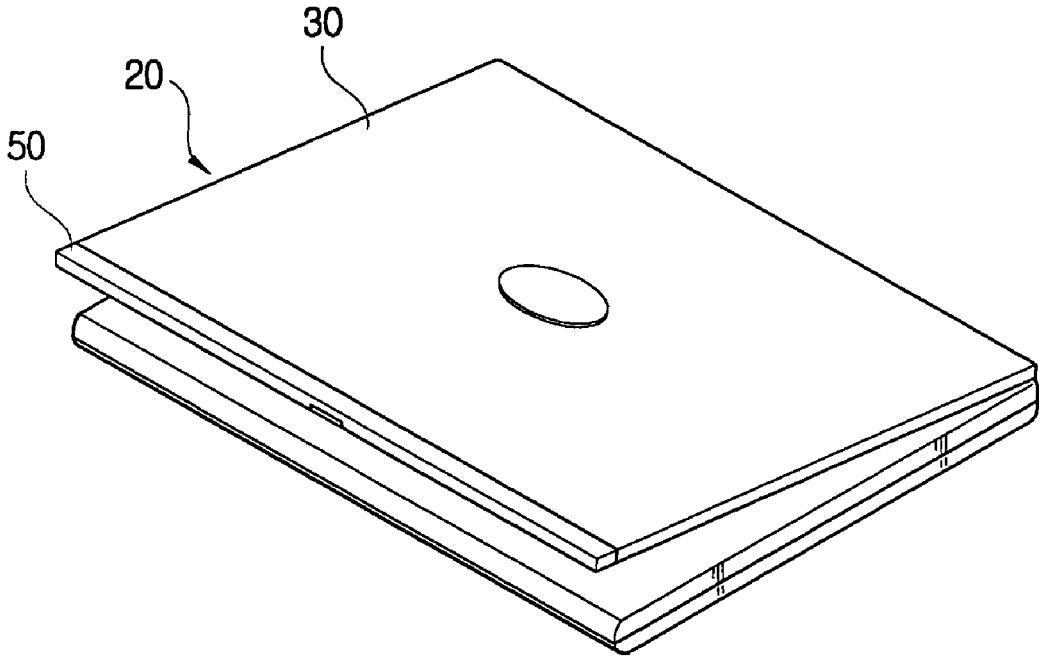
FIG. 2 is a perspective view of a notebook computer according to the present invention.
Figure 3:
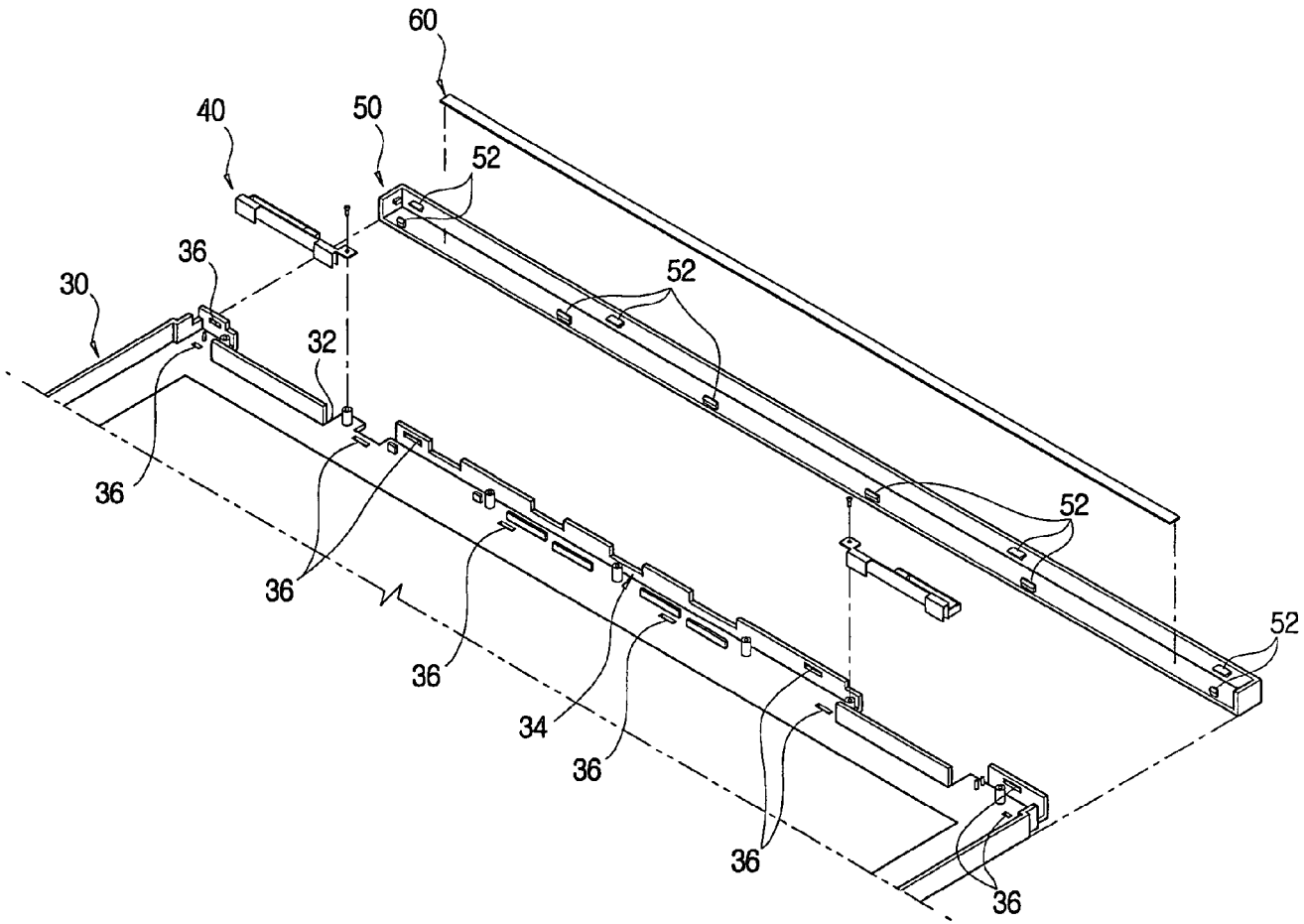
FIG. 3 is an exploded perspective view of an antenna coupling structure of the notebook computer according to the present invention.
Figure 4:
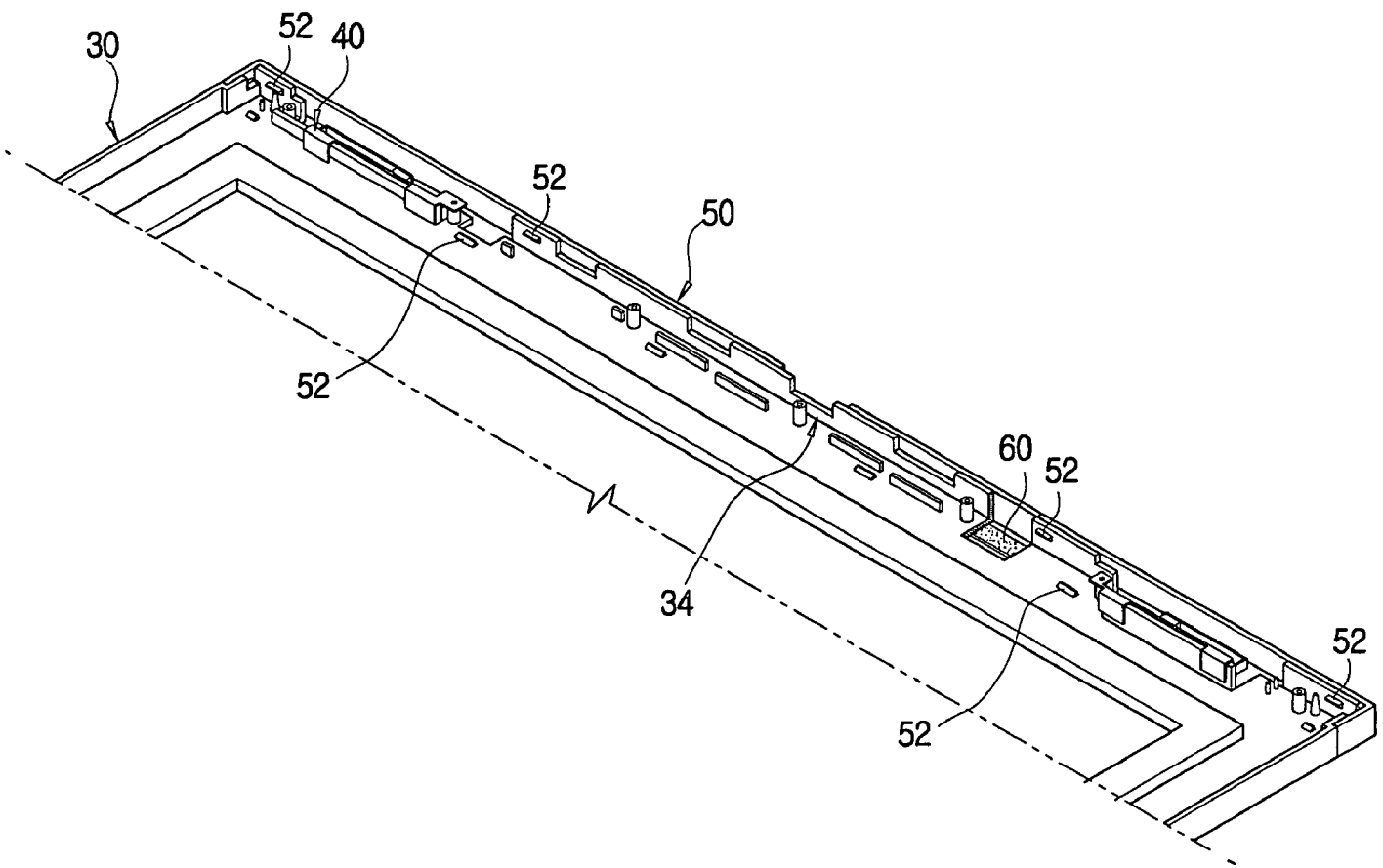
FIG. 4 is a combined perspective view of the antenna coupling structure in FIG. 3.

FIG. 2 is a perspective view of a notebook computer according to the present invention, FIG. 3 is an exploded perspective view of a coupling structure of an antenna of the notebook computer, and FIG. 4 is a combined perspective view of the coupling part in FIG. 3.

As illustrated therein, the notebook computer according to the present invention comprises a display device 20 to display a picture, a case 30 installed on the outside of the display device 20 and formed with antenna grooves 32 on opposite sides thereof, antennas 40 housed in the antenna grooves 32 of the case 30, and a cover 50 which is combined with the case 30 to cover the front side of the case 30 when the antennas 40 are in place.

The cover 50 has a plurality of combining hooks 52, and the case has a plurality of hook holes 36 corresponding to the combining hooks 52, such that they can be detachably combined easily and firmly without a separate coupling means. The combining hooks 52 and the hook holes 36 may take various shapes as long as they securely attach the cover 50 to the case 30. Also, the cover 50 may have the hook holes and the case 30 may have the combining hooks.

The cover 50 and the case 30 may be attached by using various other means and/or devices.

The cover 50 is made of plastic to minimize any negative impact on the reception of the antenna 40. Because the cover 50 is made of plastic, the combining hooks 52 can be elastically fitted into the hook holes 36, thereby minimizing any space or gap that may be formed as a result of the attachment.

In an additional aspect of the invention, the size and the shape of the cover 50 may vary according to the size and shape of the case 30, and the edges of the cover 50 are rounded to enhance the external appearance.

While the case 30 is sometimes made of plastic in consideration of the reception capability of the antennas 40 installed inside the case 30, a magnesium alloy is used in an additional aspect of the present invention due to the added protection it provides to the LCD as well as its minimal impact on the reception capability of the antenna 40. Plastics are less capable of protecting the LCD from impact. A case 30 made from magnesium alloy is light weight, and yet it is strong enough to protect the system from an external impact.

The antenna grooves 32 are formed at the opposite sides of the case 30. The number of antenna grooves varies according to the number of antennas 40.

In addition to the combining hooks 52 and the hook holes 36, an adhesive member 60 is located between opposing faces of the cover 50 and the case 30 to maintain contact between the cover 50 and the case 30. As an example, a strip of double-sided tape can be used as an adhesive member 60. The double-sided tape can be attached to the inner surface of the cover 50, such that, when the cover 50 is attached to the case 30 the double-sided tape is affixed to both the inner surface of the cover 50 and the outer surface of the case 30, thereby maintaining a more secure connection. Various devices can be employed as adhesive members 60, double-sided tape is merely an example of one type of an adhesive member 60, and is noted because of its convenience. Additional examples of adhesive members 60 are glue and epoxy.

An opening/closing part 34 may be formed on the front side of the case 30 such that user may open the display device 20. Additional antennas 40 may be added. In one aspect, a single cover 50 is able to cover the opening/closing part 34 and the antennas 40, thereby enhancing function and utility.

In another aspect of the present invention, the cover 50 covers the entire front side of the case 30, thereby enhancing the external appearance of the notebook computer.

Figure 5:
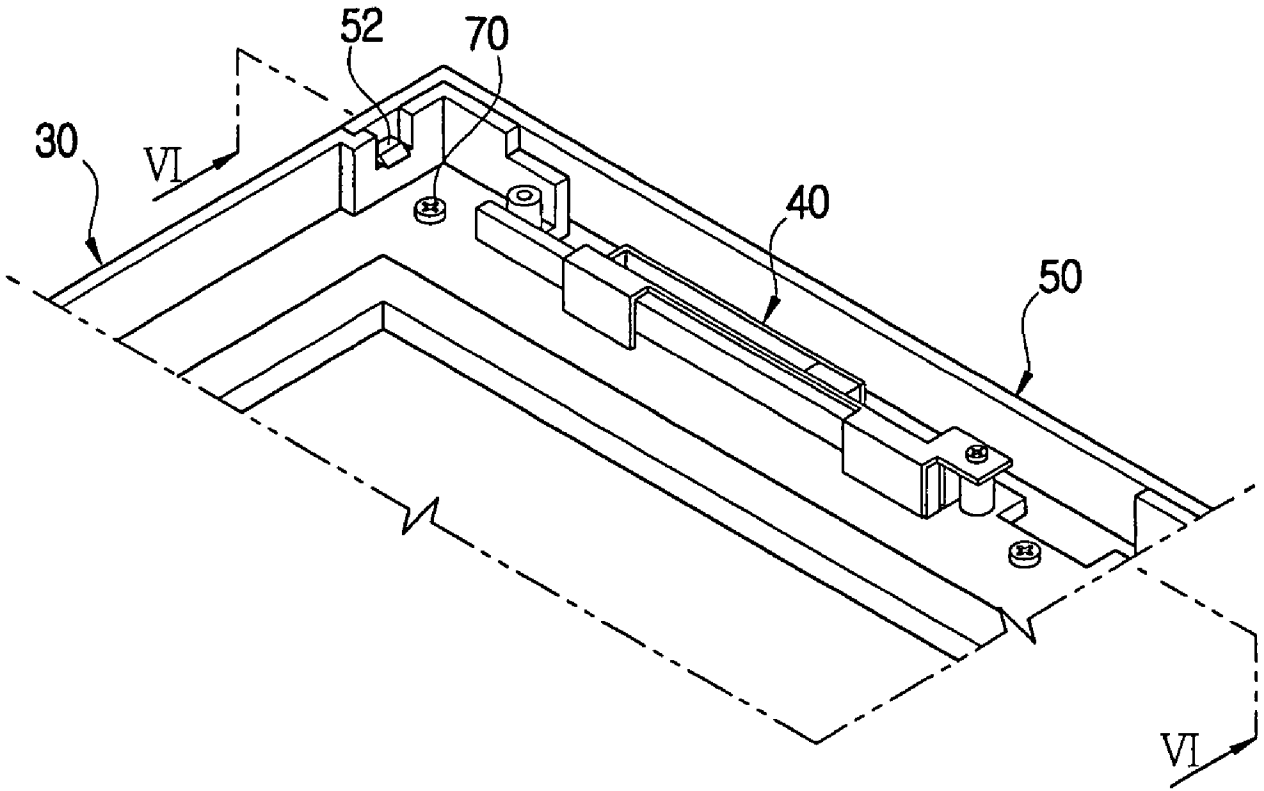
FIG. 5 is a perspective view of another embodiment of a coupling structure of a case and a cover for a notebook computer according to the present invention.
Figure 6:
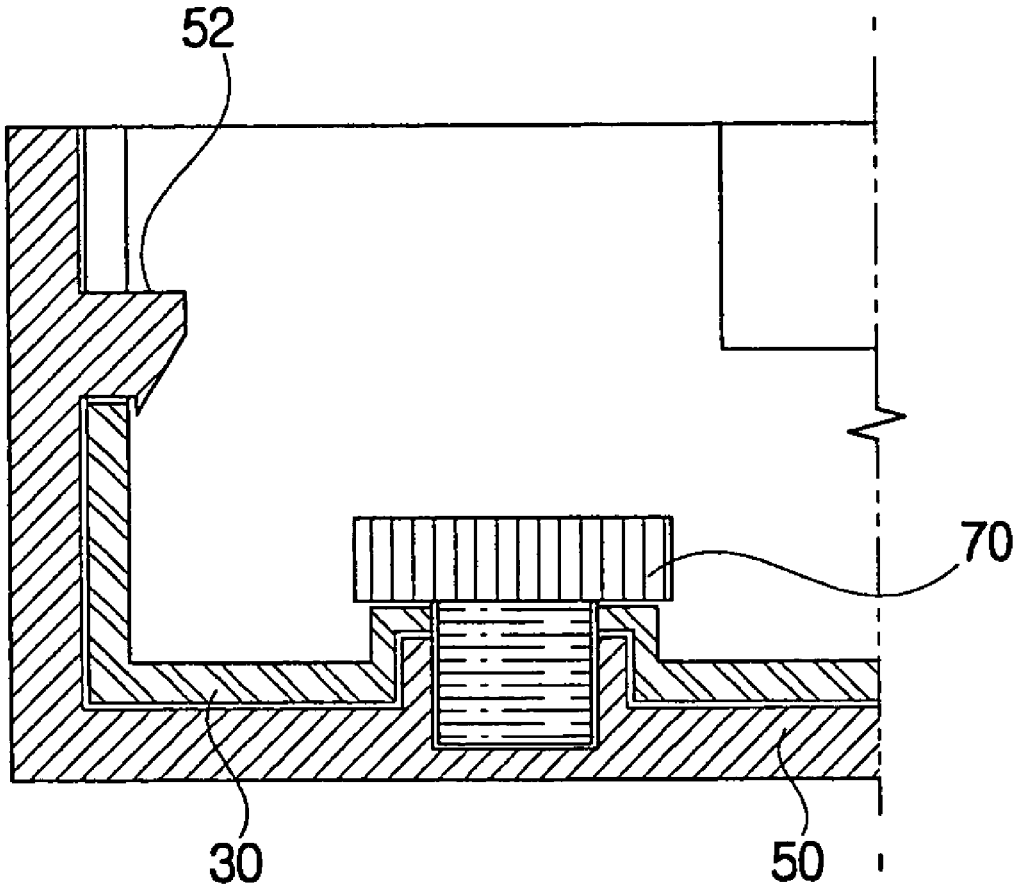
FIG. 6 is a cross-sectional view taken line VI—VI in FIG. 5.

FIG. 5 is a perspective view of another embodiment that illustrates the combining structure of the case and the cover according to the present invention. FIG. 6 is a cross-sectional view of the combining structure of the case and the cover of FIG. 5 taken along line VI—VI.

As shown in FIGS. 5 and 6, a screw 70 and the coupling hooks 52 are used together to attach the cover 50 and the case 30. In other words, the screw 70 is set back from the edges of the cover 50 and the case 30, while the coupling hooks 52 are located near the edges to prevent and/or minimize a space or gap that may form when the cover 50 and case 30 are attached.

According to the present invention, the case 30 and the cover 50 can be attached by a simple combining structure, that prevents and/or minimizes a space and/or gap that may form when they are attached.

Furthermore, there is an advantage in that the case 30 and the cover 50 can be removably attached conveniently and securely without a separate coupling means.

Additionally, the cover 50 can enhance the external appearance by covering up the entire front surface of the case 30, while making it easy to install a plurality of antennas 40.

In another embodiment of the present invention, the display being covered is an external monitor that is not attached to a laptop. This monitor could be attached to a computer or other electronic device. The monitor will generally have four edges, but it is not restricted to such by the present invention.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A notebook computer comprising:

a display device to display images;

a case attached to the outside of the display device and formed with an antenna groove on a front side thereof;

an antenna provided in the antenna groove of the case; and a cover combinable with the case to entirely cover the front side of the case and the antenna groove.

2. The notebook computer according to claim 1, wherein the cover comprises a plurality of combining hooks, and the case comprises a plurality of hook holes that correspond to the combining hooks.

3. The notebook computer according to claim 2, further comprising an adhesive member to combine the cover and the case.

4. The notebook computer according to claim 3, wherein the adhesive member comprises a length of double-sided tape.

5. The notebook computer according to claim 2, further comprising a screw located at, or near, a middle part of the cover, wherein the combining hooks are provided along edges of the cover.

6. The notebook computer according to claim 1, wherein the cover is made of plastic.

7. The notebook computer according to claim 1, wherein the case is made of magnesium alloy.

8. The notebook computer according to claim 1, wherein the case comprises a plurality of combining hooks, and the cover comprises a plurality of hook holes that correspond to the combining hooks.

9. The notebook computer according to claim 8, further comprising an adhesive member to combine the cover and the case.

10. The notebook computer according to claim 9, wherein the adhesive member comprises a length of double-sided tape.

11. The notebook computer according to claim 9, wherein the adhesive member comprises glue.

12. The notebook computer according to claim 9, wherein the adhesive member comprises epoxy.

13. The notebook computer according to claim 1, wherein a screw, to secure the cover to the case, is provided at a predetermined distance from an edge of the cover.

14. The notebook computer according to claim 1, wherein a plurality of screws, to secure the cover to the case, are provided.

15. A notebook computer comprising:

a display device to display images;

a case attached to the outside of the display device and formed with a plurality of antenna grooves on a front side thereof;

a plurality of antennas respectively mounted in the antenna grooves of the case; and a cover, combinable with the case, to entirely cover the front side of the case and the antenna grooves.

16. The notebook computer according to claim 15, wherein the cover further comprises a plurality of combining hooks, and the case comprises a plurality of hook holes that correspond to the combining hooks.

17. The notebook computer according to claim 15, wherein the cover further comprises an adhesive member to minimize the formation of spaces and/or gaps when the cover is attached to the case.

18. The notebook computer according to claim 16, wherein the cover further comprises an adhesive member to minimize the formation of spaces and/or gaps when the covers are attached to the case.

19. The notebook computer according to claim 15, wherein the cover is made of plastic.

20. The notebook computer according to claim 15, wherein the case is made of magnesium alloy.

* * * * *